US005180062A

United States Patent [19]

Stables

[11] Patent Number: 5,180,062

[45] Date of Patent: Jan. 19, 1993

[54] FABRIC MATCH METHOD AND SET

[76] Inventor: Nancy J. Stables, 16795 Mellen La., Jupiter, Fla. 33478

[21] Appl. No.: 817,454

[22] Filed: Jan. 6, 1992

[51] Int. Cl.[5] ..... B65D 71/00; B44D 3/00

[52] U.S. Cl. ..... 206/574; 206/459.5; 356/402; 434/99

[58] Field of Search ..... 206/81, 425, 450, 459, 206/460, 574, 575; 223/1, DIG. 1; 356/402, 412; 434/99

[56] References Cited

U.S. PATENT DOCUMENTS

| | | | |
|---|---|---|---|
| 1,629,330 | 5/1927 | Adler . | |
| 1,704,793 | 3/1929 | Field . | |
| 1,718,919 | 6/1929 | Fitzgibbon . | |
| 1,733,539 | 3/1929 | Hertel . | |
| 1,978,925 | 10/1934 | Williams | 206/459 |
| 3,008,248 | 11/1961 | Steinthal | 206/450 |
| 3,040,448 | 6/1962 | Paxton . | |
| 3,978,593 | 9/1976 | Pulitzer et al. | 434/99 |
| 4,909,632 | 3/1990 | McFarlane . | |
| 4,921,094 | 5/1990 | van den Akker | 206/457 |
| 4,979,324 | 12/1990 | Rehtmeyer et al. . | |

FOREIGN PATENT DOCUMENTS

| | | | |
|---|---|---|---|
| 1403094 | 5/1965 | France | 206/459 |

*Primary Examiner*—Jimmy G. Foster
*Attorney, Agent, or Firm*—Frank Benasutti

[57] ABSTRACT

A set is provided which includes a tag, removably attached to an article of clothing, having a swatch of the material from which the clothing was made and an indication of the type of clothing and the year in which it was purchased; and an index box for arranging tags in accordance with the type of clothing purchased. Also provided is a tag holder for subsequent shopping. The method of using these by removing the tags from the clothing, placing them in the index box, and subsequently removing them and transporting them for comparision shopping purposes is disclosed.

7 Claims, 2 Drawing Sheets

FABRIC MATCH METHOD AND SET

TECHNICAL FIELD

This invention relates generally to fashion coordination systems and specifically to a fabric match system for matching fashionable garments and accessories over a substantial period of time after purchase.

BACKGROUND ART

As is recognized in fashion circles, it is desirable to coordinate garments and accessories. Manufacturers and retailers encourage that activity on the part of the consumer and various means have been devised over the years to help facilitate such coordination. For example in U.S. Pat. No. 1,733,539 a color card is disclosed comprising a plurality of pieces of various materials disposed upon one another on a backing sheet and having a cover sheet with an outline of a garment which can be adjusted over the materials such that the (outline which is a cut-out portion) will disclose a simulated appearance of a garment and other color coordinated garments. Also, for the first time buyer, there is a device shown in U.S. Pat. No. 1,704,793 which comprises a piece of material, such as paper, with the image of a garment on it (in this case a suit) and a cut-out for the place where the tie would fit. When this is wrapped about a tie, the viewer can determine whether that tie would fit with the suit (which the person may or may not have with them at the time of the purchase). U.S. Pat. No. 1,718,919 discloses a stocking tag, which supplies information in the form of a color chart with each pair of hosiery.

After one has purchased a tie, for example, U.S. Pat. No. 3,040,448 discloses a means for relating that tie to the various types of suits with which it may be warn.

As for the person wearing the garment, U.S. Pat. 4,909,632 discloses a method of determining color compatibility of the individual person on the basis of skin color. U.S. Pat. No. 1,629,330 discloses a color harmony device, particularly related to the color of the person's hair.

DISCLOSURE OF INVENTION

In accordance with the present invention, there is disclosed a set of devices for use with garments as well as a method where by the purchaser of a garment may continue to make color harmonizing selections for years thereafter. It comprises a set comprising a tag with a swatch of material on it, an illustration of the garment from which it came and a color or other indicia of the year in which the garment was purchased. A box is provided, in which these tags may be kept and indexed in accordance with the type of garment. Also provided is a holder for the tags which one may carry with them on a shopping trip.

An advantage of this set of devices is that the purchaser of a garment may more easily shop for matching accessories or clothing at a later date. Further they may evaluate at a glance the quantity of any specific clothing they have by referring to the index box. Also, they will be able to update their wardrobe at a glance.

These and other advantages will become apparent from the following descriptions with reference to the accompanying drawings.

MODES FOR CARRYING OUT THE INVENTION

Figure 1:
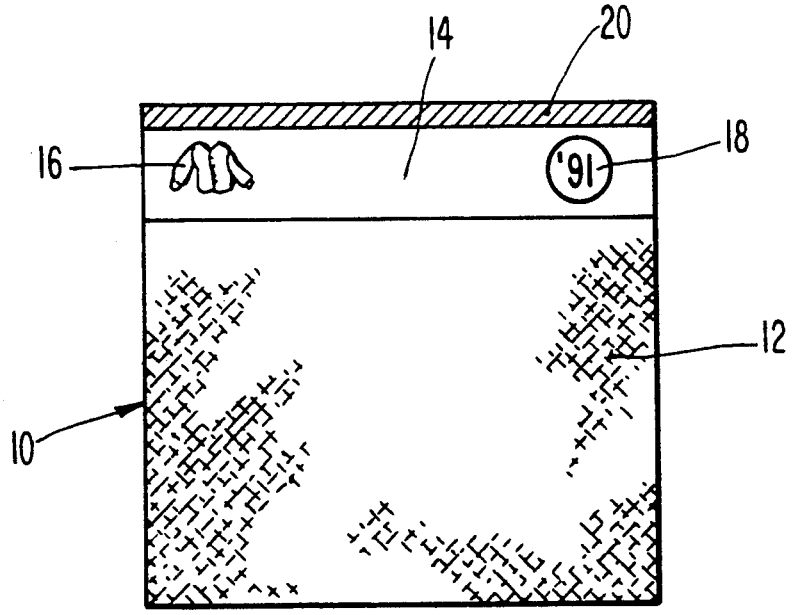
FIG. 1 is a front elevation of a card in accordance with my invention.

Referring to the figures, FIG. 1 shows a tag 10 in accordance with my invention, which consists of a laminated plastic having encased therein a swatch of fabric. This may be done in any suitable manner (not shown) such as by making a pouch for insertion of the fabric swatch, designated generally 12. The fabric will be the same as that being used to produce the article of clothing upon which the tag will be placed. The card includes and area, designated generally 14, at the top for displaying indicia of various kinds. For example, there is an emblem 16, identifying the type of clothing made from the fabric. There is a year designator 18, identifying the year in which the garment was made, and there is a color bar 20, printed across and over the top (so that it is visible from the top when stored in the container 22) which also designates the year. It will be understood, in accordance with this invention, the color bar will change each year so that it can be readily recognized when viewing the card in its container, FIG. 2. The tags are most preferably 2"×2" and made of clear plastic.

Figure 2:
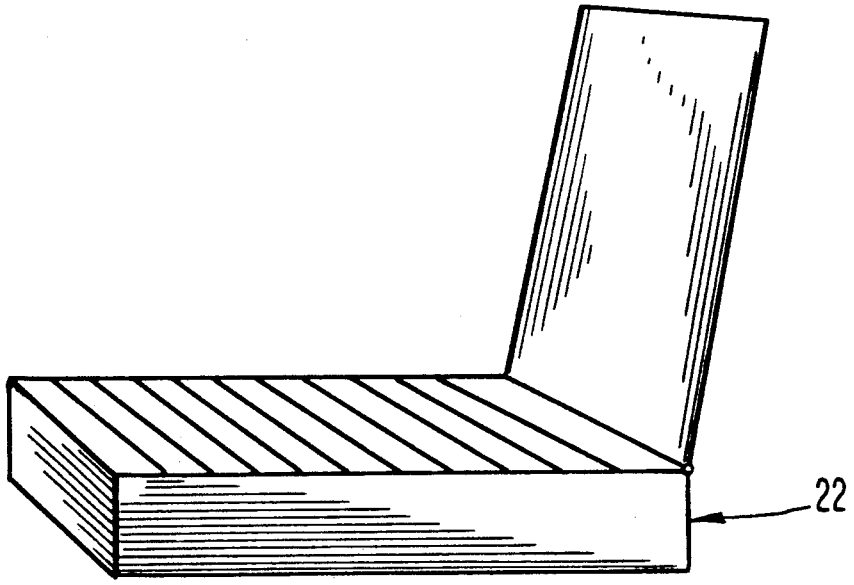
FIG. 2 is a perspective view of a card container in accordance with my invention.
Figure 4:
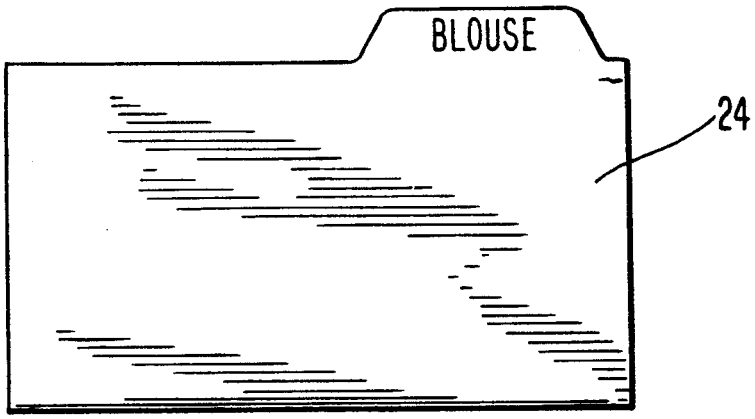
FIG. 4 is a front elevation of an index card for use with the card of FIG. 1 and the container of FIG. 2.

Referring now to FIG. 2, there is shown an index box or container 22, constructed to accommodate the tags 10, and including a plurality of index cards 24, FIG. 4. The index cards identify the type of garment, such as a blouse, so that the cards can be filed in order, behind the index card corresponding to the emblem of clothing. In the figures illustrated, for example, index card 24 shows a blouse and the article of clothing shown by the emblem on the tag 10, is also a blouse.

The box 22, may be made of colored plastic to coordinate with the decor of the dressing area, such as the bedroom, bathroom, etc., and will most preferably be 2.5"×8" and include a cover.

Figure 3:
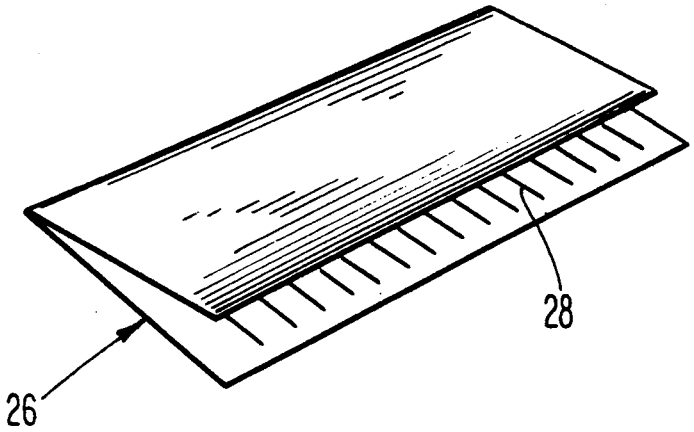
FIG. 3 is a perspective view of a card holder in accordance with my invention.

In accordance with my invention the set also includes a tag holder 26, FIG. 3, which will most preferably be manufactured of a material that will coordinate with other handbag accessories such as wallets, key holders, make-up cases, etc. When going shopping the customer will remove the tag (card) 10, from the index box (container) 22, corresponding to the article of clothing for which the is shopping, and place it in one of the pouches created by the slots 28 in tag holder holder, 26. This holder has not been described in further detail since it is conventional per se, and can be in any convenient form, such as those currently used for holding credit cards.

METHOD OF OPERATION

In accordance with this invention, the manufacturer of clothing will include a card as part of a tag attached to the clothing, which can be readily removed without damaging the garment. The tag will include a swatch of fabric from which the piece of clothing is manufactured. The consumer upon buying the clothing will remove the tag, and the card and place it in the index box behind the listing of a category of clothing for that card, such as a blouse, shorts, skirt, suit, etc. At a later date, if the consumer wishes to purchase a suit to go with the blouse, or a skirt to go with the blouse, the consumer will pull out the blouse card, stick it into their tag holder, and go shopping. At each stop, where a comparison would be useful, the consumer can remove the card and use the swatch to match or coordinate with the article under consideration.

I claim:

1. A set comprising a first card and a container for use in matching clothing with other articles, comprising:

said first card having a swatch of fabric in engagement therewith; and indicia on said first card indicating the article of clothing made from the fabric; and said container adapted and configured to receive and contain said first card therein; said container having a plurality of spaces defined by index cards; said index cards having indicia thereon corresponding to the indicia on said first card such that said first card may be placed in one of the spaces defined by the index cards for retrieval.

2. The invention of claim 1 wherein the set also includes a card holder to receive said first card removed from the container whereby said first can be transported and accessed for use in comparing fabrics with other articles.

3. The invention of claim 1 wherein said first card has indicia thereon indicating the year.

4. The invention of claim 3 wherein said indicia indicating the year comprises a color visible from the top of said first card when positioned in said container, and differing from year to year.

5. A method of matching clothing to other articles, comprising:

providing a tag for association with said clothing;

providing a swatch of the material from which the clothing was made;

engaging said swatch with said tag;

providing indicia on said tag indicating the type of clothing to which said tag will be attached;

detachably attaching said tag to said clothing;

providing a container for storing said tag;

providing an indexing means whereby a plurality of said tags may be indexed within said container according to the indicia of clothing on said tags;

removing the tag from the article of clothing an placing it in a container;

removing the tag from the container, so that it may be used to match articles of clothing with a swatch of material.

6. The invention of claim 5, wherein the additional steps of:

providing a holder for transporting said tag subsequent to removing it from the container and prior to using it to match articles.

7. The invention of claim 6 wherein the method includes placing the tag in the holder for transport subsequent to removing it from the container and prior to using it to match articles with the clothing.

* * * * *